US006412553B1

(12) United States Patent
Akerlund

(10) Patent No.: US 6,412,553 B1
(45) Date of Patent: Jul. 2, 2002

(54) APPARATUS FOR POSITIONING A TONG AND DRILLING RIG PROVIDED WITH SUCH AN APPARATUS

(75) Inventor: Tor Jan Akerlund, Forus (NO)

(73) Assignee: Weatherford/Lamb, L.L.P., Houston, TX (US)

( * ) Notice: Subject to any disclaimer, the term of this patent is extended or adjusted under 35 U.S.C. 154(b) by 0 days.

(21) Appl. No.: 09/355,439

(22) PCT Filed: Nov. 19, 1997

(86) PCT No.: PCT/GB97/03174

§ 371 (c)(1),
(2), (4) Date: Nov. 29, 1999

(87) PCT Pub. No.: WO98/32947

PCT Pub. Date: Jul. 30, 1998

(30) Foreign Application Priority Data

Jan. 29, 1997 (GB) ..... 9701790

(51) Int. Cl.[7] ..... E21B 19/18
(52) U.S. Cl. ..... 166/77.51; 166/85.1; 175/85
(58) Field of Search ..... 175/52, 85; 166/77.51, 166/77.52, 77.53, 85.1; 81/57.35

(56) References Cited

U.S. PATENT DOCUMENTS

| | | | | |
|---|---|---|---|---|
| 2,668,689 A | | 2/1954 | Cormany | 81/57.16 |
| 2,692,059 A | | 10/1954 | Bolling, Jr. | |
| 3,518,903 A | | 7/1970 | Ham et al. | 81/57.18 |
| 3,838,613 A | | 10/1974 | Wilms | 81/57.34 |
| 3,881,375 A | | 5/1975 | Kelly | 81/57.35 |
| 4,077,525 A | | 3/1978 | Callegari et al. | 214/2.5 |
| 4,277,197 A | | 7/1981 | Bingham | 403/104 |
| 4,440,220 A | | 4/1984 | McArthur | 166/85 |
| 4,681,158 A | | 7/1987 | Pennison | 166/77.5 |
| 4,843,945 A | * | 7/1989 | Dinsdale | 81/57.34 |
| 5,060,542 A | | 10/1991 | Hauk | 81/57.34 |
| 5,354,150 A | * | 10/1994 | Candales | 405/154 |
| 5,368,113 A | | 11/1994 | Schulze-Beckinghausen | 175/162 |
| 5,386,746 A | | 2/1995 | Hauk | 81/57.34 |
| 5,667,026 A | | 9/1997 | Lorenz et al. | 175/162 |
| 5,931,231 A | * | 8/1999 | Mock | 166/377 |

FOREIGN PATENT DOCUMENTS

| | | |
|---|---|---|
| GB | 1469661 | 7/1974 |
| WO | WO90/06418 | 6/1990 |
| WO | WO 92/18743 | 10/1992 |

* cited by examiner

*Primary Examiner*—David Bagnell
*Assistant Examiner*—Jennifer Dougherty
(74) *Attorney, Agent, or Firm*—Moser, Patterson & Sheridan, L.L.P.

(57) ABSTRACT

An apparatus for positioning a tong comprises a piston and cylinder assembly (101) and a mounting assembly (102) therefor. The mounting assembly (102) is mounted on a support beam in the drilling derrick and the piston and cylinder assembly (101) is pivotally mounted on the mounting assembly. The piston and cylinder assembly (101) can be pivoted between an operative position in which it can be extended and retracted to move a tong towards and away from a string of tubulars, and an inoperative position in which the piston and cylinder assembly (101) extends along an upwardly extending axis with part of the piston and cylinder assembly (101) disposed to either side of the mounting assembly (102).

15 Claims, 2 Drawing Sheets

APPARATUS FOR POSITIONING A TONG AND DRILLING RIG PROVIDED WITH SUCH AN APPARATUS

This invention relates to an apparatus for positioning a tong and a drilling rig provided with said apparatus.

In our PCT Publication No. WO 95/10686 we have described an apparatus for positioning a tong which comprises two rigid members which are each formed by connecting two chains each of which is independently flexible. Whilst this apparatus functions extremely well it is expensive to manufacture and to maintain.

In FIG. 4 of the Patent Application we suggested the use of hydraulic piston and cylinder assemblies as an alternative to the chains. This has not been adopted commercially as the hydraulic pistons and cylinders and associated tong could not readily be moved out of the way to facilitate other operations on the rig floor.

With a view to reducing this problem the present invention provides an apparatus for positioning a tong, which apparatus comprises a piston and cylinder assembly, and a mounting assembly therefor, characterised in that said piston and cylinder assembly can be pivoted between an operative position in which it can be extended and retracted to move a tong towards and away from a string of tubulars, and an inoperative position in which said piston and cylinder assembly extends along an upwardly extending axis with part of said piston and cylinder assembly disposed to either side of said mounting assembly.

Typically, in use, said mounting assembly will be mounted on a support beam which is from 2 to 3 m above the rig floor.

Preferably, said piston and cylinder assembly comprises a piston and cylinder mounted within a telescopically extensible structure.

Advantageously, said piston and cylinder has two stages and said telescopically extensible barrel comprises an outer barrel, an intermediate structure and an inner barrel.

Preferably, said mounting assembly comprises a bearer which can be clamped to a structural member in a drilling tower, a carriage pivotally mounted on said bearer and a clamp assembly for securing said piston and cylinder assembly to said mounting assembly.

Advantageously, said apparatus includes a motor, for example a hydraulic motor, actuable to adjust the position of said piston and cylinder assembly with respect to said mounting assembly.

The present invention also provides a drilling floor, a support beam adjacent said drilling floor, the mounting assembly of an apparatus in accordance with the present invention mounted on said support beam, the piston and cylinder assembly of an apparatus in accordance with the present invention mounted on said mounting assembly and a tong attached to the free end of said piston and cylinder assembly.

For a better understanding of the present invention reference will now be made, by way of example, to the accompanying drawings, in which.

Figure 1:
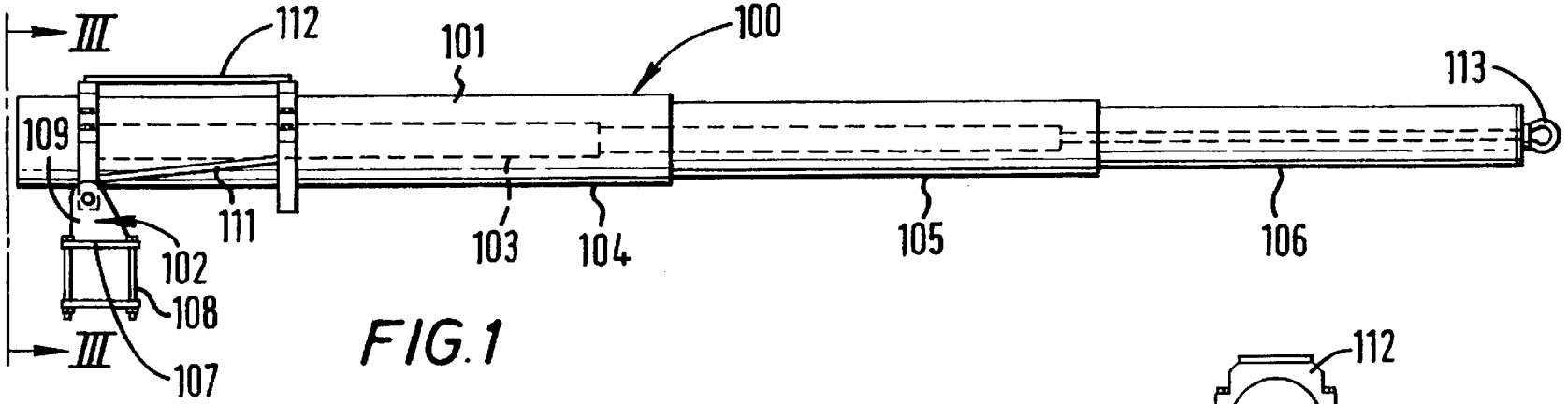
FIG. 1 is a side elevation of one embodiment of an apparatus in accordance with the present invention in an operative position.
Figure 3:
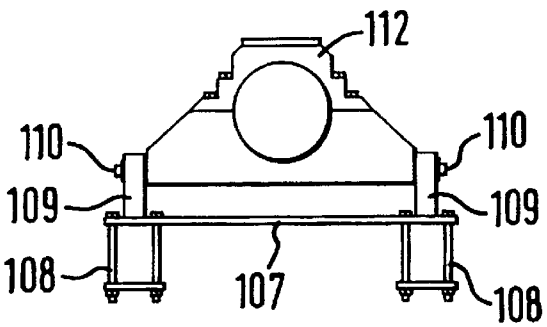
FIG. 3 is an end view taken on line III—III of FIG. 1.
Figure 2:
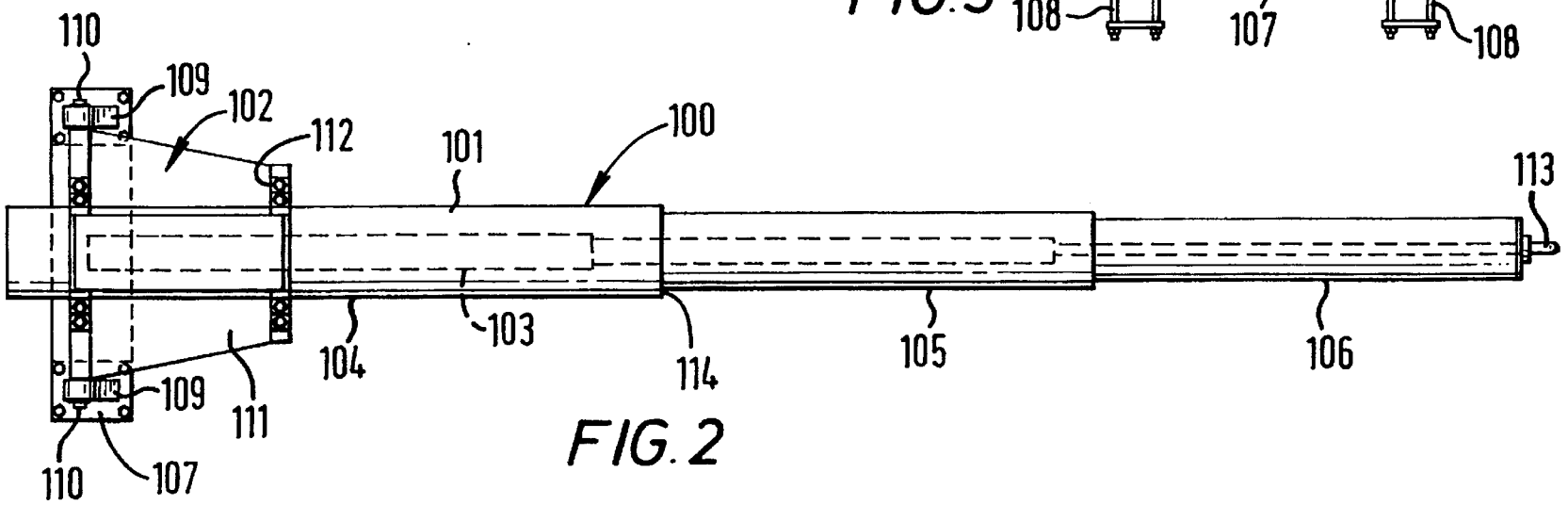
FIG. 2 is a top plan view of the apparatus shown in FIG. 1.

Referring to FIGS. 1 to 3 of the drawings there is shown an apparatus for positioning a tong. The apparatus, which is generally identified by the reference numeral 100, comprises a piston and cylinder assembly 101 and a mounting assembly 102.

The piston and cylinder assembly 101 comprises a conventional two stage hydraulic piston and cylinder 103 which is mounted internally of a telescopic structure which comprises an outer barrel 104, an intermediate barrel 105 and an inner barrel 106. The inner barrel 106 is slidably mounted in the intermediate barrel 105 which is, in turn, slidably mounted in the outer barrel 104.

The mounting assembly 102 comprises a bearer 107 which can be secured to a beam by two bolt and plate assemblies 108. The bearer 107 includes two ears 109 which accommodate trunnions 110 which project from either side of a carriage 111.

A clamp assembly 112 is bolted to the top of the carriage 111 and maintains the piston and cylinder assembly 101 in position with respect to the mounting assembly 102.

In use, the mounting assembly 102 is first secured to a convenient support beam in the drilling rig by bolt and plate assemblies 108. If necessary a support beam may be mounted in the drilling rig for this purpose.

The piston and cylinder assembly 101 is then mounted on the carriage 111 and clamped in position.

A tong is then attached to the free end 113 of the piston and cylinder assembly 101 which is moved with respect to the mounting assembly 102 so that, at full extension, the tong is in the desired position with respect to well centre.

In normal use the tong can be moved towards and away from well centre by extending and retracting the hydraulic piston and cylinder 103. The outer barrel 104, intermediate barrel 105 and inner barrel 106 extend and contract with the hydraulic piston and cylinder 103 and provide lateral rigidity to the structure. At full extension the piston and cylinder assembly 101 can be deflected from side to side by a small amount. This movement can readily be accommodated by the two stage hydraulic piston and cylinder 103 although, if desired, the ends thereof could be mounted on, for example, ball and socket joints or resilient mountings.

Figure 4:
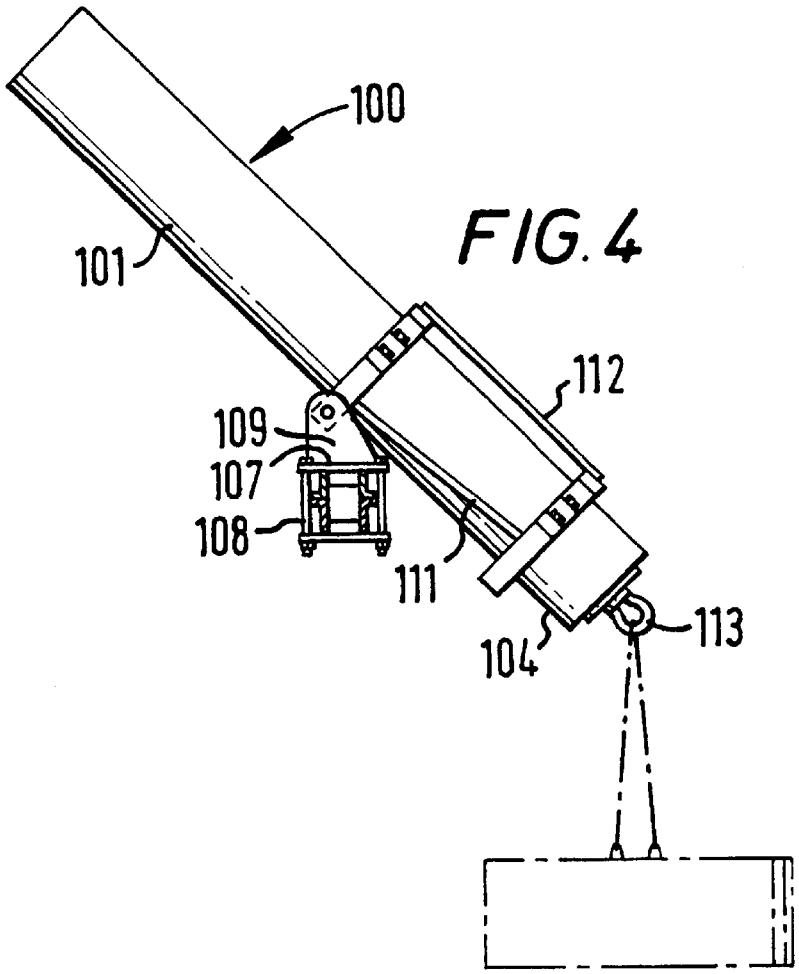
FIG. 4 is a perspective view showing the apparatus connected to a tong with the apparatus in a first inoperative position.

It will be appreciated that when the piston and cylinder assembly 101 is fully retracted the free end 113 will lie immediately adjacent the extremity 114 of the outer barrel 104. For many purposes such retraction would be insufficient and consequently manipulation of tongs by piston and cylinder assemblies has heretofore been deemed untenable. The present invention provides a simple and elegant solution to the problem. In particular, the clamp assembly 112 can simply be slackened, the piston and cylinder 101 slid on the carriage 111 until the extremity 114 lies adjacent the mounting assembly 102 and the clamp assembly 112 re-tightened. When the piston and cylinder assembly 101 is fully contracted the free end 113 of the piston and cylinder assembly 101 lies closely adjacent the mounting assembly 102 with the tong therebelow. This can clearly be seen in FIG. 4. It will be noted that the piston and cylinder assembly 101 lies on an upwardly extending axis and that a major portion of the piston and cylinder assembly 101 lies to the rear of the mounting assembly 102. It will be noted that in this position the tong rests on the workshop floor which simulates the drilling floor.

Figure 5:
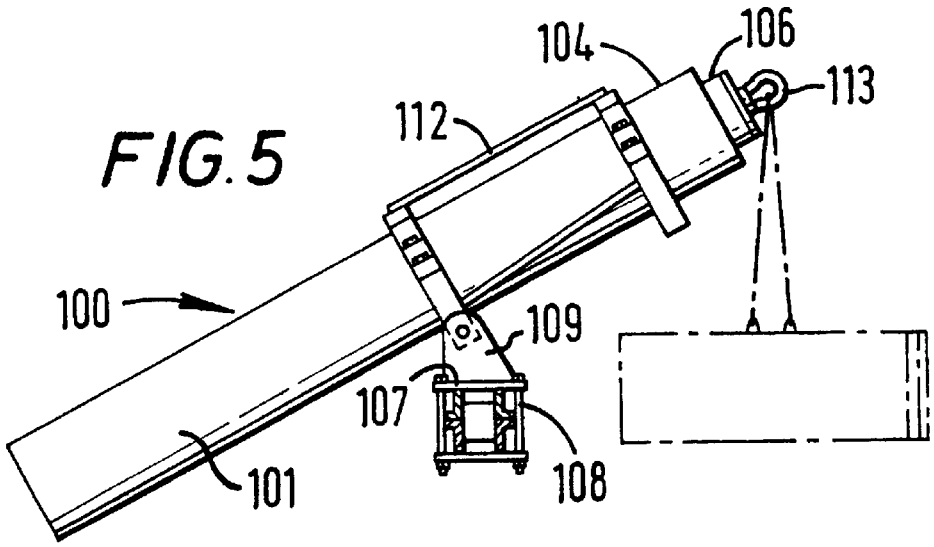
FIG. 5 is a perspective view showing the arrangement of FIG. 4 with the apparatus in a second inoperative position.

An alternative inoperative position is shown in FIG. 5. In this position the tong is suspended from an overhead cable whilst the piston and cylinder assembly 101 again lies along an upwardly extending axis.

For certain operations it may be desirable to remove the tong completely. In such a case the apparatus 100 can simply be parked in the inoperative position shown in FIG. 4 or FIG. 5. Preferably, a locking device is provided to ensure that the piston and cylinder assembly 101 remains in its parked position.

The apparatus 100 is preferably made of aluminium and is thus comparatively light and easy to handle.

Various modifications to the apparatus 100 are envisaged. For example, a small hydraulic motor could be provided to move the piston and cylinder assembly 101 with respect to the mounting assembly 102. If desired, means could be provided to enable the outer barrel 104 to be swivelled with respect to the mounting assembly 102 or the mounting assembly 102 itself to be capable of swivelling movement. This would be useful in a situation where the tongs were required, for example both to make up and break out a pipe string in the well centre and to make up or break out joints in an adjacent location to one side of the well centre. If desired the piston and cylinder assembly 103 could be pneumatically actuable although this would give this arrangement some "bounce" which might not be desired.

What is claimed is:

1. An apparatus for positioning a tong, which apparatus comprises a piston and cylinder assembly (101), a mounting assembly (102) and a clamp assembly (112) wherein said clamp assembly (112) maintains the position of the piston and cylinder assembly (101) relative to the mounting assembly (102), characterized in that said piston and cylinder assembly (101) can be pivoted between an operative position in which the piston and cylinder assembly (101) can be extended and retracted to move a tong towards and away from a string of tubulars while maintaining a constant position relative to the mounting assembly (102), and an inoperative position in which said clamp assembly (112) is adjusted so that said piston and cylinder assembly (101) extends relative to said mounting assembly (102) along an upwardly extending axis with part of said piston and cylinder assembly (101) disposed to either side of said mounting assembly (102).

2. The apparatus as claimed in claim 1, wherein said piston and cylinder assembly (101) comprises a piston and cylinder (103) mounted within a telescopically extensible structure (104, 105, 106).

3. The apparatus as claimed in claim 2, wherein said piston and cylinder (103) has two stages and said telescopically extensible structure comprises an outer barrel (104), an intermediate barrel (105) and an inner barrel (106).

4. The apparatus as claimed in claim 1, wherein said mounting assembly (102) comprises a bearer (107) which can be clamped to a structural member in a drilling tower and a carriage (111) pivotally mounted on said bearer (107).

5. The apparatus as claimed in claim 1, including a motor actuable to adjust the position of said piston and cylinder assembly (101) with respect to said mounting assembly (102).

6. An apparatus for positioning a tong comprising:

a piston and cylinder assembly disposed within a telescopically extensible structure;

a tong attached to one end of the piston and cylinder assembly;

a mounting assembly coupled to the other end of the piston and cylinder assembly wherein a clamp assembly maintains the position of the piston and cylinder assembly relative to the mounting assembly.

7. The apparatus according to claim 6 wherein the telescopically extensible structure further comprises an outer barrel, an intermediate barrel and an inner barrel.

8. The apparatus according to claim 7 wherein the piston and cylinder assembly can be pivoted between an operative position in which the mounting assembly maintains the outer barrel in a constant position relative to the mounting assembly and an inoperative position in which the mounting assembly is adjusted so that the outer barrel is moveable relative to the mounting assembly.

9. An apparatus for positioning a tong, comprising:

a piston and cylinder assembly comprising an outer barrel;

a tong attached to one end of the piston and cylinder assembly;

a clamp assembly attached to the outer barrel that maintains the position of the piston and cylinder assembly relative to a mounting assembly, wherein, the piston and cylinder assembly can be pivoted between an operative position in which the clamping assembly maintains the outer barrel in a first position relative to the mounting assembly and an inoperative position in which the clamping assembly is adjusted so that the outer barrel may be moved to a second position relative to the mounting assembly.

10. An apparatus for positioning a tong, which apparatus comprises a piston and cylinder assembly (101) and a mounting assembly (102) therefore, characterized in that said piston and cylinder assembly (101) can be pivoted between an operative position in which the piston and cylinder assembly (101) can be extended and retracted to move a tong towards and away from a string of tubulars, and an inoperative position in which said piston and cylinder assembly (101) extends along an upwardly extending axis with part of said piston and cylinder assembly (101) disposed to either side of said mounting assembly (102), wherein said piston and cylinder assembly (101) comprises a piston and cylinder (103) mounted within a telescopically extensible structure (104, 105, 106), and wherein said piston and cylinder (103) has two stages and said telescopically extensible structure comprises an outer barrel (104), an intermediate barrel (105) and an inner barrel (106).

11. An apparatus for positioning a tong, which apparatus comprises a piston and cylinder assembly (101) and a mounting assembly (102) therefore, characterized in that said piston and cylinder assembly (101) can be pivoted between an operative position in which the piston and cylinder assembly (101) can be extended and retracted to move a tong towards and away from a string of tubulars, and an inoperative position in which said piston and cylinder assembly (101) extends along an upwardly extending axis with part of said piston and cylinder assembly (101) disposed to either side of said mounting assembly (102), wherein said mounting assembly (102) comprises a bearer (107) which can be clamped to a structural member in a drilling tower, a carriage (111) pivotally mounted on said bearer (107) and a clamp assembly (112) for securing said piston and cylinder assembly (101) to said mounting assembly (102).

12. An apparatus for positioning a tong comprising:

a piston and cylinder assembly disposed on a telescopically extendable structure, the tong attached to one end of the piston and cylinder assembly, wherein the telescopically extendable structure is a single cantilevered structure; and a mounting assembly coupled to an opposite end of the piston and cylinder assembly, the telescopically extendable structure being pivotable about a horizontal axis.

13. The apparatus of claim 12, wherein the telescopically extendable structure is pivotable about a vertical axis.

14. The apparatus of claim 12, wherein the mounting assembly comprises:

a bearer which can be affixed to a structural member in a drilling tower; and a carriage pivotally mounted on the bearer.

15. The apparatus of claim 12, wherein the telescopically extendable structure comprises an outer barrel, an intermediate barrel, and an inner barrel.

* * * * *